US006267342B1

(12) United States Patent
Huang

(10) Patent No.: US 6,267,342 B1
(45) Date of Patent: Jul. 31, 2001

(54) ATTACHABLE CORD HOLDER FOR A CHRISTMAS LIGHT

(76) Inventor: Shun-Feng Huang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/550,750

(22) Filed: Apr. 12, 2000

(51) Int. Cl.[7] ..... A47G 1/01

(52) U.S. Cl. ..... 248/316.7; 248/51; 362/249; 362/391; 362/396

(58) Field of Search ..... 362/249, 226, 362/252, 391, 396, 806; 248/314, 316.7, 231.81, 51

(56) References Cited

U.S. PATENT DOCUMENTS 4,970,632 * 11/1990 Tseng ..... 362/226
5,697,698 * 12/1997 Huang ..... 362/226
5,908,238 * 6/1999 Huang ..... 362/391
5,913,597 * 6/1999 Lin ..... 362/226
5,941,628 * 8/1999 Chang ..... 362/249
6,062,711 * 5/2000 Huang ..... 362/391
6,068,229 * 5/2000 Wang ..... 248/314
6,082,874 * 7/2000 Huang ..... 362/226

* cited by examiner

*Primary Examiner*—Leslie A. Braun
*Assistant Examiner*—Gwendolyn Baxter

(57) ABSTRACT

An attachable cord holder for a Christmas light includes an arcuate plate slidably inserted into a pair guide slots behind rectangular notch in the top of a socket of the light, a hook of roughly U-shaped section connected to the arcuate plate having a narrow entrance into the top and a thumbpiece extended outward from a flange of a base of the light having a round surfaced protrusion projected downward from the free end and engageable with the entrance of the hook. When a cord is transversely disposed into the hook, the round surfaced protrusion of the thumbpiece is pressed downward and frictionally inserted into the entrance of the hook to tightly close the entrance.

1 Claim, 7 Drawing Sheets

ATTACHABLE CORD HOLDER FOR A CHRISTMAS LIGHT

BACKGROUND OF THE INVENTION

The present invention relates to Christmas lights and more particularly to an attachable cord holder for a Christmas light which holder is releasable and can be transversely holding a cord in order to facilitate a user to knit a horizontal network of the Christmas lights.

Typical Christmas light 10 (as shown in FIG. 1) comprises a pair of lugs 12 symmetrically formed on the opposing outer peripheries of a socket 11 for vertically holding a cord 13 for knitting a network of the Christmas lights. This type of lug 12 has a disadvantage that the cord 13 can only go parallel to the longitudinal direction of the Christmas light and can not go perpendicular to the longitudinal direction of the Christmas light. Therefore, the knitting of the Christmas lights is limited and the network is not to be versatile.

SUMMARY OF THE PRESENT INVENTION

The present invention has a main object to provide an attachable cord holder for a Christmas light which holder facilitates a transverse holding of the cord in order to obtain a versatility of a network of a Christmas lights.

Another object of the present invention is to provide an attachable cord holder for a Christmas light in which a thumbpiece is provided to prevent the cord from breaking away of the holder.

The present invention will become more fully understood by reference to the following detailed description thereof when read in conjunction with the attached drawings.

DETAILED DESCRIPTION OF THE PREFERRED EMBODIMENT

Figure 1:
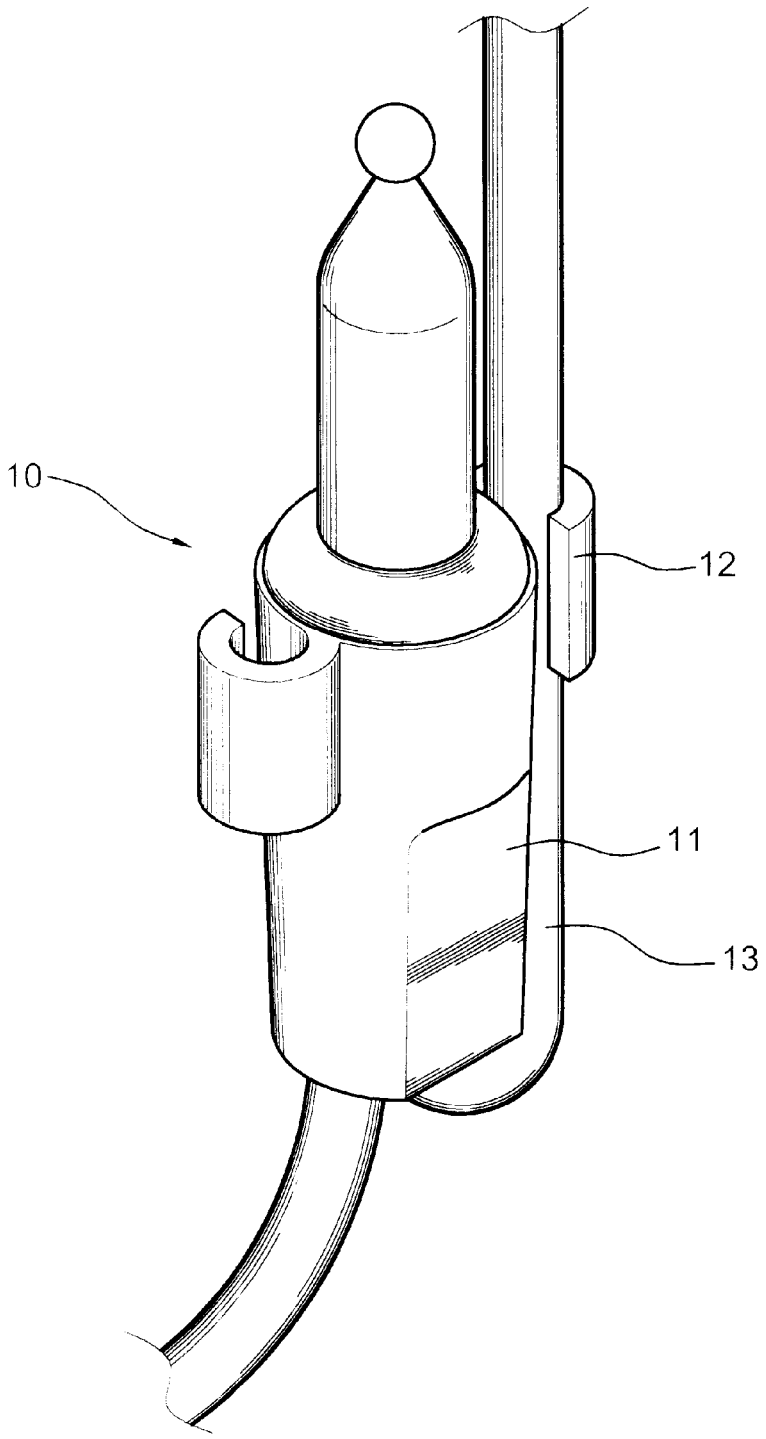
FIG. 1 Prior Art
FIG. 1 is a perspective view to show a Christmas light according to a prior art.
Figure 2:
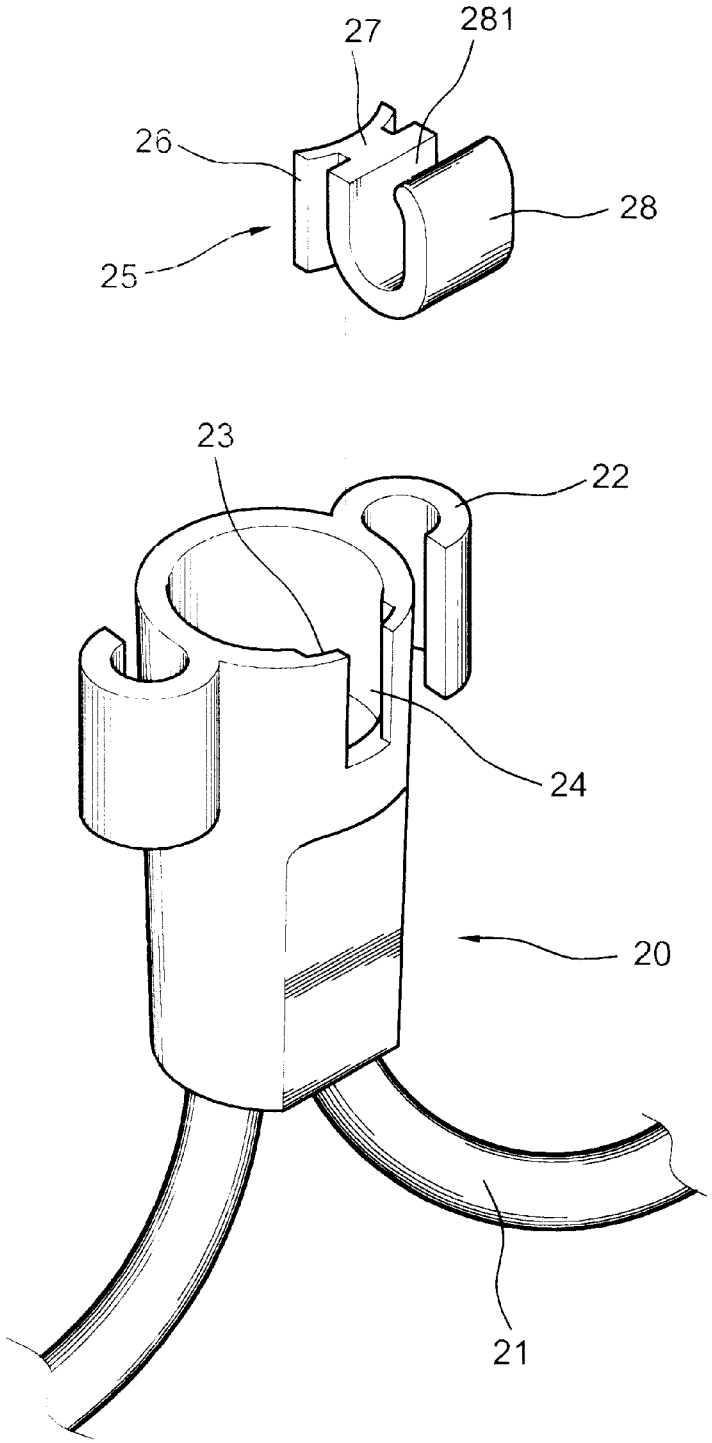
FIG. 2 is an exploded perspective view to show a hook attachable to a socket of the Christmas light.
Figure 3:
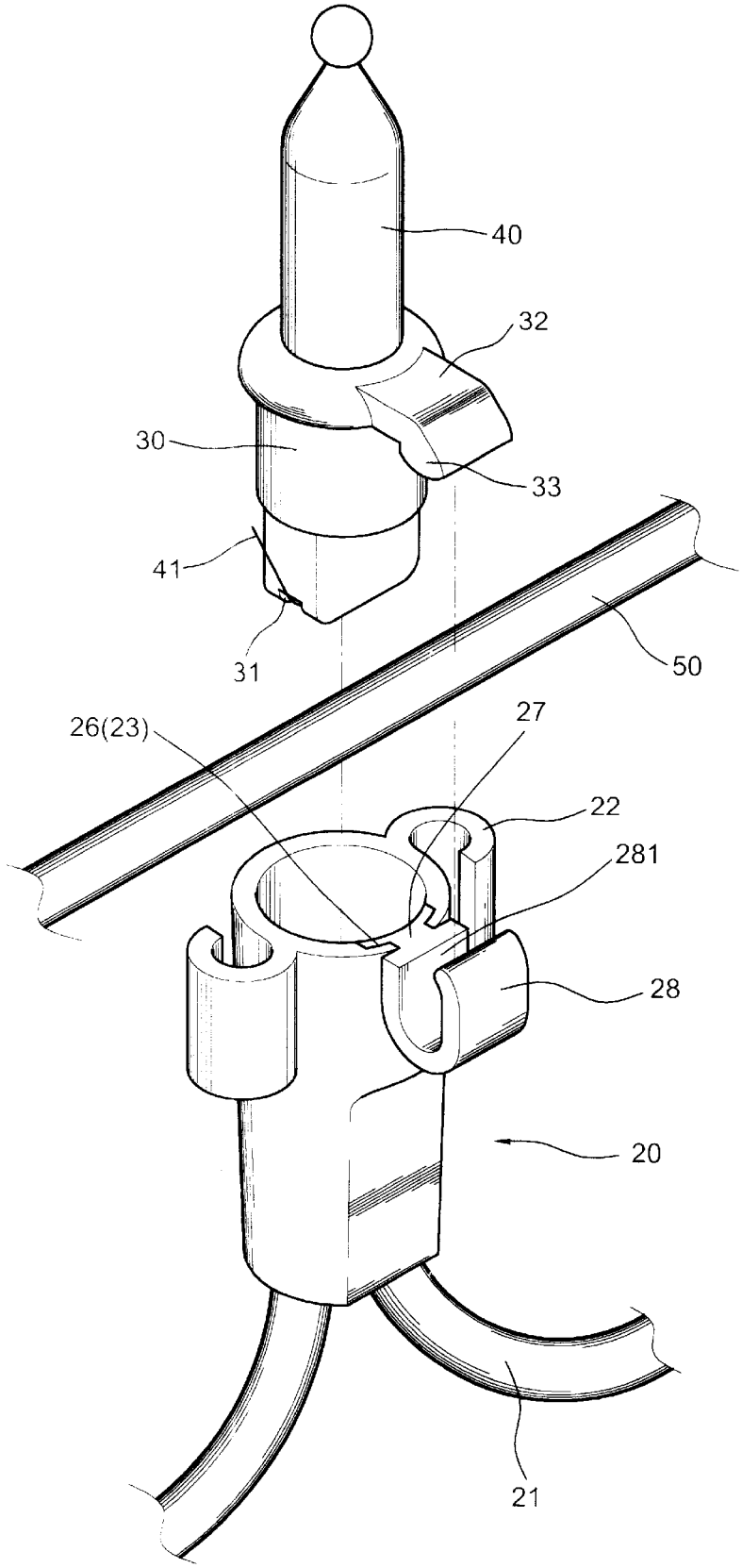
FIG. 3 is an exploded perspective view to show a preferred embodiment according to the present invention.
Figure 4:
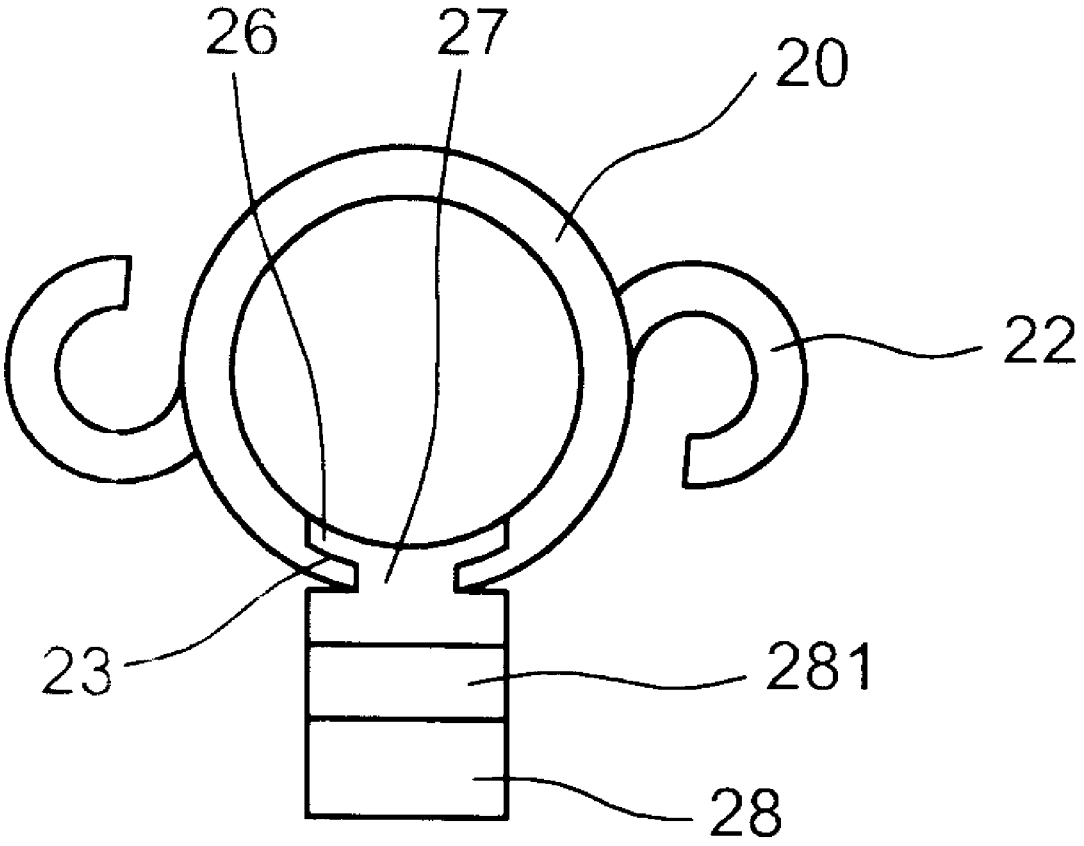
FIG. 4 is a top plane view to show a hook attached to the socket of the Christmas light.

With reference to FIGS. 2 to 4 of the drawings, the attachable cord holder for a Christmas light of the present invention comprises generally a tubular socket 20, a base 30 axially engaged into the socket 20 and a lamp axially inserted into the base 11 with a pair lead-in wires 41 respectively attached to the lateral sides through a pair of small notches 31 in underside of the base. When the base 30 engages into the socket 20, the lead-in wire 41 will automatically engage with a pair of contact plates (not shown) on the top of the electrical cords 21 inside the socket 20.

The socket 20 has a pair of lugs 22 symmetrically formed on opposing outer peripheries for holding electrical cords, a rectangular notch 24 in a lateral side between the lugs 22 and abutting the top of the socket 20 and a pair of guide slots 23 abutting the inner wall of the notch 24.

A cord holder 25 has an arcutate plate 26 slidably engaged into the guide slots 23 of the socket 20, a hook 28 of roughly U-shaped section having one end connected to the arcuate plate 26 with a narrow piece 27. The hook 28 has a narrow entrance 281 in the top for permitting an electrical cord to be entered into the hook 28.

The base 30 further has a thumbpiece 32 projected outward from an upper flange including a round surfaced protrusion 33 projected downward from the free end of the thumbpiece 32 for blocking the narrow entrance 281 of the hook 28.

Figure 5:
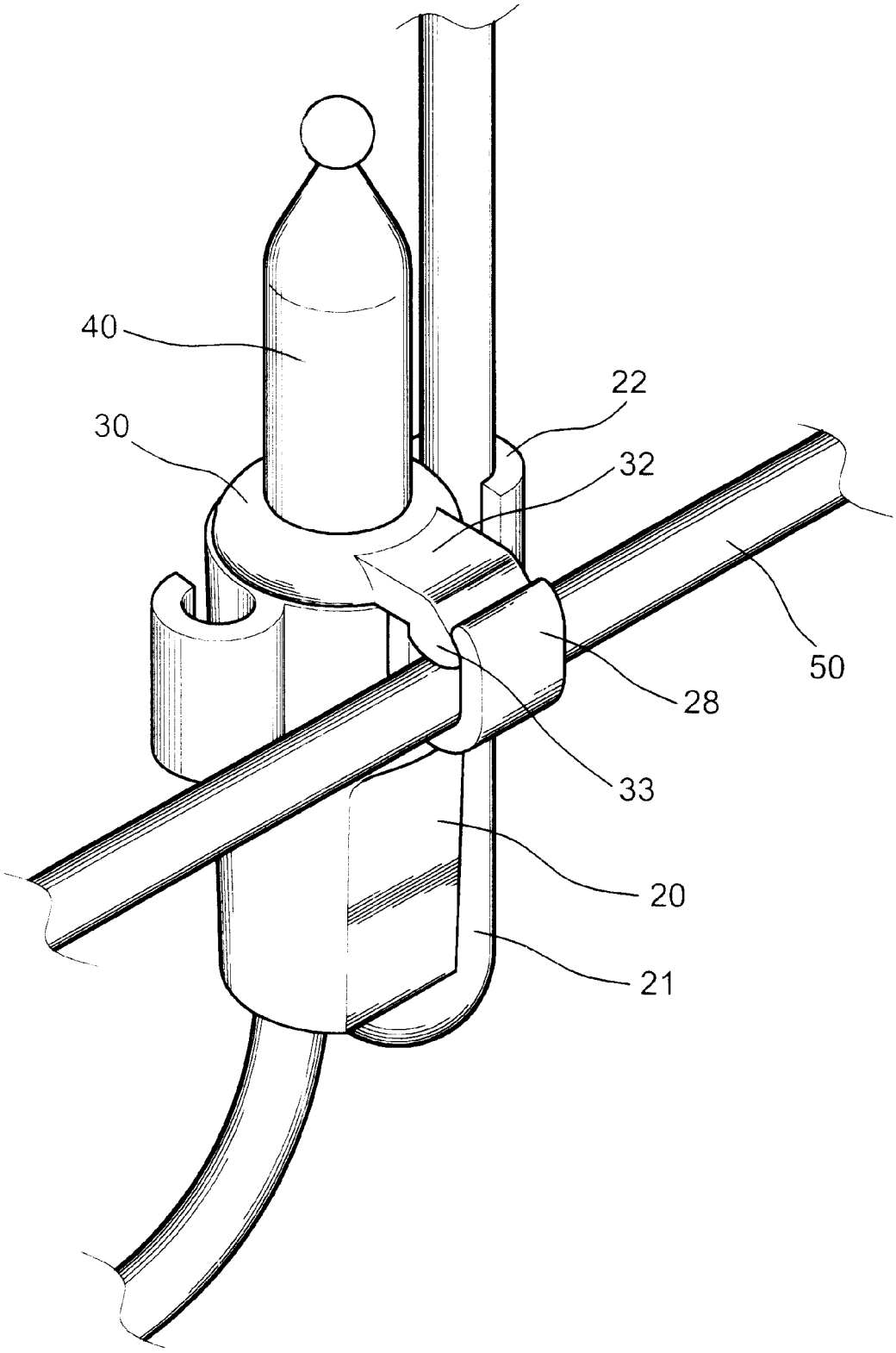
FIG. 5 is a perspective view to show an assembly of FIG. 3.
Figure 6:
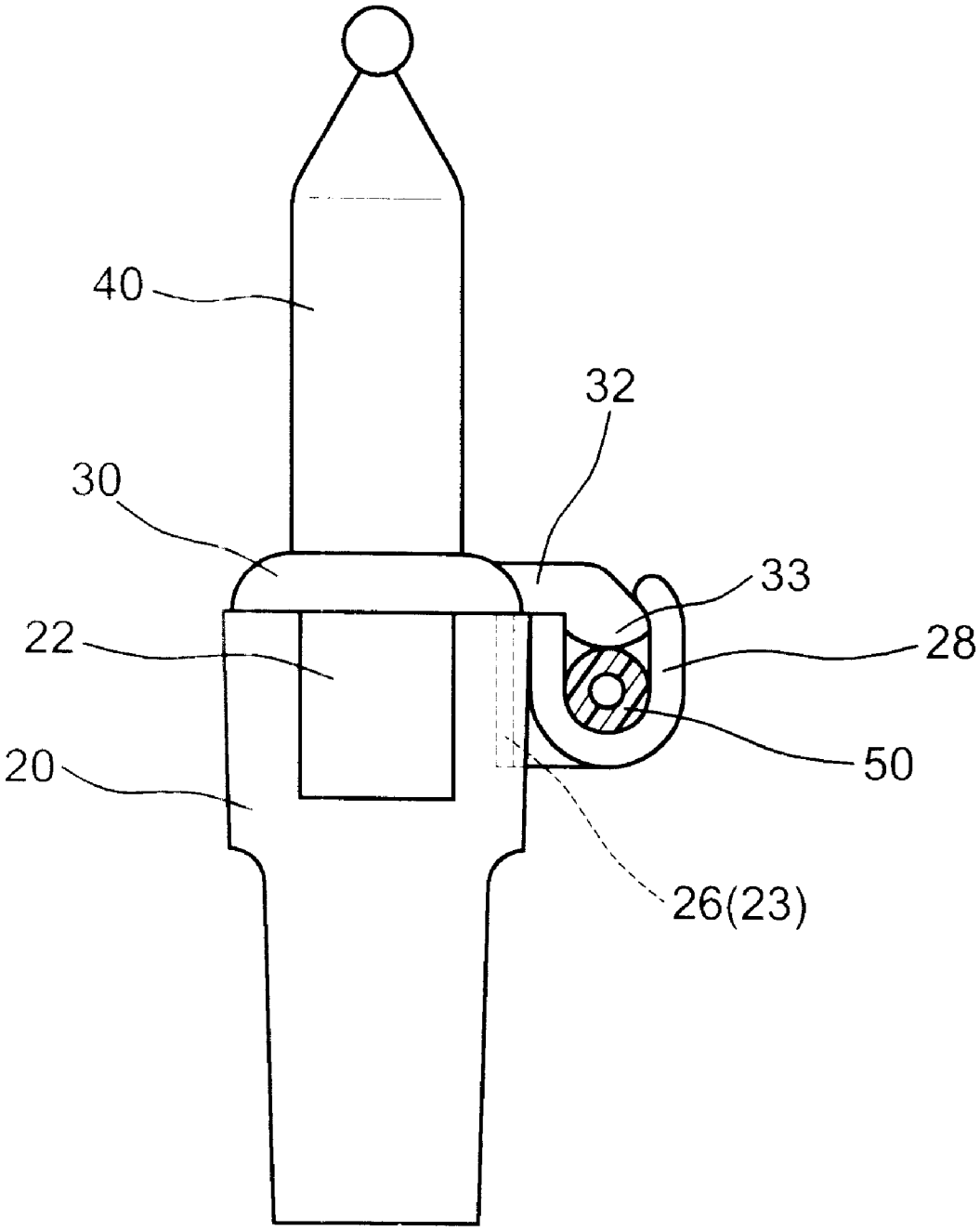
FIG. 6 is a side view of FIG. 6.

Referring to FIGS. 5 and 6, when a cord 50 transversely disposes into the hook 28, then insert the base 30 into the socket 20 and press the thumbpiece 32 downward so that the protrusion 33 is frictionally entered into the entrance 281 of the hook 28, therefor, the cork 50 is tightly held in the hook 28.

Figure 7:
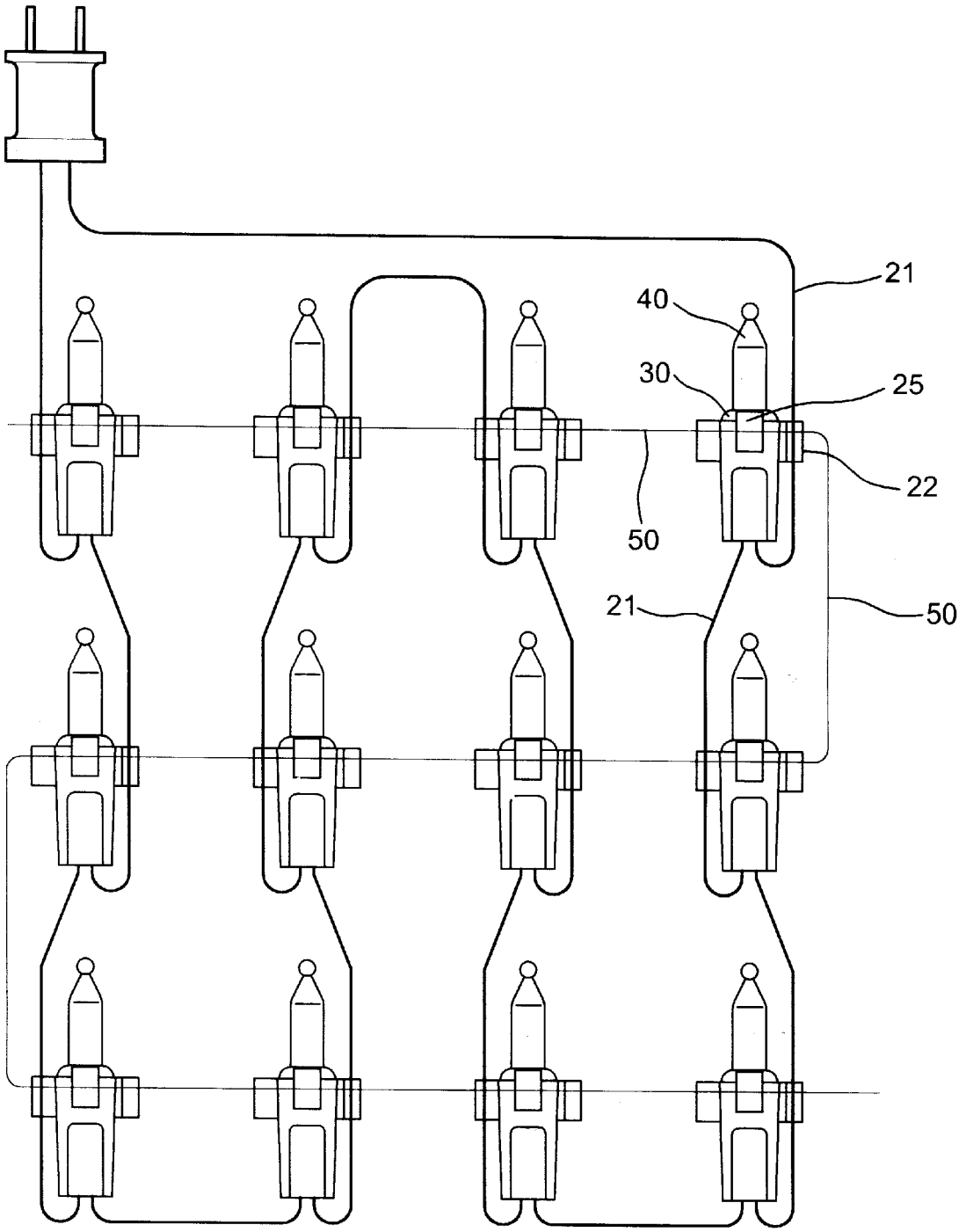
FIG. 7 is a plane view to show a network of Christmas lights knitted by the Christmas lights of the present invention.

FIG. 7 shows a network knitted with the Christmas lights of the present invention in which the electrical cords 21 are respectively held by the lugs and go parallel to the longitudinal direction of the lights. Whereas, the cords 50 are respectively held by the cord holders 25 and go perpendicular to the longitudinal direction of the lights.

The specification relating to the above embodiment should be construed as exemplary rather than as limitative of the present invention, with many variations and modifications being readily attainable by a person of average skill in the art without departing from the sprit or scope thereof as defined by the appended claims and their legal equivalents.

I claim:

1. An attachable cord holder for a Christmas light comprising:

a tubular socket having a pair of lug means symmetrically formed on opposing peripheries for respectively holding an electrical cord being parallel to the longitudinal direction of the socket, a rectangular notch in an upper periphery abutting the top thereof between the lug means, a pair of guide slots formed in an inner wall behind the rectangular notch and a pair of the electrical cords extending outward from bottom thereof each including a contact plate on top and disposed inside said socket;

a cord holder attached to the rectangular notch of said socket and having an arcuate plate slidably engaged into the guide slots of said socket and a hook of U-shaped section including a narrow entrance in top and connected on an upper end with the arcuate plate with a narrow pieces;

a base axially inserted into the socket and having a flange on top, a lamp axially disposed into the base with a pair of lead-in wires respectively attached to a pair of lateral sides thereof through a pair of small notches into bottom of the base, said lead-in wires respectively engaged with the contact plate of the electrical cord when the base in inserted into the socket, and a thumbpiece projected outward from a periphery of said flange including a round surfaced protrusion projected downward from free end thereof and frictionally engaged into the narrow entrance of the hook after a cord is transversely disposed into the hook.

* * * * *